United States Patent [19]

Leniger

[11] 4,279,128

[45] Jul. 21, 1981

[54] HEAT PUMP SWIMMING POOL HEATER

[75] Inventor: David J. Leniger, Vancouver, Wash.

[73] Assignees: Alfred R. Edwards; Gene R. Price, both of Vancouver, Wash.

[21] Appl. No.: 34,273

[22] Filed: Apr. 30, 1979

[51] Int. Cl.[3] ..... F25B 27/02; F25B 13/00

[52] U.S. Cl. ..... 62/238.6; 62/238.7

[58] Field of Search ..... 62/238 E, 324 D

[56] References Cited

U.S. PATENT DOCUMENTS

| | | | |
|---|---|---|---|
| 3,498,072 | 3/1970 | Stiefel | 62/238 E |
| 3,513,663 | 5/1970 | Martin, Jr. et al. | 62/238 E |
| 3,926,008 | 12/1975 | Webber | 62/238 E |
| 3,959,986 | 6/1976 | Ledermann | 62/324 D |
| 4,019,338 | 4/1977 | Poteet | 62/238 E |
| 4,141,222 | 2/1979 | Ritchie | 62/238 E |

FOREIGN PATENT DOCUMENTS

| | | | |
|---|---|---|---|
| 1929063 | 1/1971 | Fed. Rep. of Germany | 62/324 |
| 2421617 | 11/1975 | Fed. Rep. of Germany | 62/238 E |

*Primary Examiner*—Lloyd L. King
*Attorney, Agent, or Firm*—Chernoff & Vilhauer

[57] ABSTRACT

A swimming pool heating system which utilizes a heat pump that is used for heating heat transfer fluid which is circulated through the primary coil of a heat exchanger. The pool water is circulated through the secondary coil of the heat exchanger by means of a standard pool pump. Rather than heating all of the water which is handled by the pump, a system bypass line is connected to the pool outlet line and a diverter valve, which is located in the pool return line, is used to divert a portion of the circulated pool water to the heating system. A three-way regulator valve located in the system bypass line divides the diverted pool water, directing a selected portion of it to the heat exchanger and a selected portion of it to the pool return line in order to automatically control the heating effect the pool heater has on the heat transfer fluid, thereby keeping the discharge pressure of the heat pump relatively constant so that it operates in its most efficient range. A defrost bypass is associated with the regulator valve in order to override the regulator valve when the heat pump operates in a defrost cycle, thereby ensuring that adequate pool water is directed to the heat exchanger to provide a sufficient heating load. A thermostatic control is included to allow heat pump operation to be responsive to the swimming pool heating demand and a pressure control terminates operation of the system upon discontinued or reduced availability of pool water.

8 Claims, 2 Drawing Figures

HEAT PUMP SWIMMING POOL HEATER

BACKGROUND AND SUMMARY OF THE INVENTION

This invention relates to a heating system for swimming pools and in particular to such a system which utilizes a heat pump.

In the past electricity has been the predominant energy source for heating swimming pools, due to its being a readily available and clean source of energy. In the past when electrical energy has been used for this purpose, it has normally been used in the form of resistance heating, however, resistance heating is inefficient and as the cost of electrical power increases it becomes increasingly desirable to use other, more efficient, types of electrical heating, such as a heat pump. Even though heat pumps are relatively efficient means of utilizing electrical energy for heating they have certain operating characteristics which seriously limit their use for heating swimming pools. In the operation of a heat pump it is imperative that the pressure of the heat transfer fluid as it is discharged from the heat pump remain relatively constant. Otherwise the heat pump will often be operating in a range where its efficiency is significantly reduced. This characteristic of heat pumps is not a serious limitation when they are used for space heating since the heat capacity of the air being heated is much lower than that of the heat transfer fluid. Therefore, even when the space being heated becomes quite cool, the discharge pressure, is not overly effected. In addition, even if the discharge temperature of the heat transfer fluid is reduced below the desirable range, the space is raised to the desired temperature rather quickly and then kept at a relatively constant temperature. Therefore, any effect temperature has on operating efficiency of the heat pump is of short duration and thus of little importance.

On the other hand, the water being heated in a swimming pool has a much larger heat capacity than air. Therefore, when cool water is being heated it is much more likely to cause the discharge temperature of the heat transfer fluid to drop than is the case with air. Furthermore, it typically takes a much longer time to heat a cool swimming pool than a cool house and accordingly the heat pump will be forced to operate in an inefficient mode for a much longer period of time in the former case than in the latter.

What is needed, therefore, is a means for automatically regulating the discharge pressure of the heat transfer fluid in a heat pump when the heat pump is used for heating a swimming pool, so that the heat pump always operates within its desired range.

The heating system of the present invention serves this end by continuously regulating the amount of pool water which is subjected to being heated by the heat pump, thereby causing the heat pump to be operated at a constant discharge pressure.

The heating system of the present invention includes a system bypass line, which is connected to the pool outlet line, to divert a portion of the pool water to the heating system. A manually operable diverter valve located in the pool return line ensures that a controlled amount of water is so diverted. The diverted portion of the pool water is then passed through the secondary coil of a commercially available heat exchanger which has the heated heat transfer fluid from the heat pump being circulated through its primary coil.

The regulating element consists of a three-way regulator valve which is located in the system bypass line upstream of the heat exchanger. The regulator valve is connected so that its inflow port receives pool water from the pool, a first outlet port discharges water into a regulator return line which is connected to the pool return and a second outflow port discharges water back into the pool bypass line for passage to the heat exchanger. The position of the regulator valve is responsive to the discharge pressure of the heat transfer fluid through operation of control means so that if the pool water causes undue cooling of the heat transfer fluid from the heat pump, therefore causing its temperature, and thus its pressure, to drop, the regulator valve will direct a greater portion of the pool water out of its first outflow port thus correcting this effect. On the other hand, when the discharge pressure of the heat transfer fluid increases, a greater portion of the pool water is passed out of the second outflow port to the heat exchanger. As a result, the discharge pressure remains relatively constant and within the range where the heat pump operates more efficiently. While the regulator valve maintains the heat pump within its desired range, a separate thermostatically controlled switch located in the pool outlet line causes the heat pump to initiate and terminate operation responsive to pool demand.

One drawback of using a regulator valve of this type is that it operates to eliminate any heating load from being available when the heat pump is reversed to defrost its evaporator coil. In this event as the heat transfer fluid passing to the heat exchanger becomes cooled, since in this configuration the heat pump is operating as a refrigeration unit, the regulator valve would normally respond by directing an increasingly greater portion of the pool water through the regulator return line rather than through the heat exchanger. Thus there would be increasingly less pool water available to serve as a heat source for the heat pump as it continued in its defrost cycle.

In the present invention this problem is solved by placing a defrost bypass line between the inflow and second outflow ports of the regulator valve and placing a solenoid-operated first bypass control valve in the bypass line. In addition, a solenoid-operated second bypass control valve is located in the regulator return line. Accordingly, the bypass control valves are annunciated by the heat pump controls so that during defrost the first valve is opened and the second valve is closed. As a result, all of the pool water is directed through the heat exchanger to act as the heat source for the heat pump.

Accordingly, it is a principal object of the present invention to provide a system for heating a swimming pool with a heat pump wherein the discharge pressure of the heat transfer fluid in the heat pump automatically remains within a predetermined range at all times.

It is a further object of the present invention to provide such a system wherein the heat pump can also be operated in a defrost cycle.

It is a further object of the present invention to provide such a system which is operated on a demand basis responsive to pool temperature.

It is a still further object of the present invention to provide such a system having an emergency shutdown which terminates operation of the heat pump in the event the flow of pool water is discontinued or severely curtailed.

The foregoing and other objectives, features and advantages of the present invention will be more readily understood upon consideration of the following detailed description of the invention taken in conjunction with the accompanying drawings.

DESCRIPTION OF A PREFERRED EMBODIMENT

Figure 1:
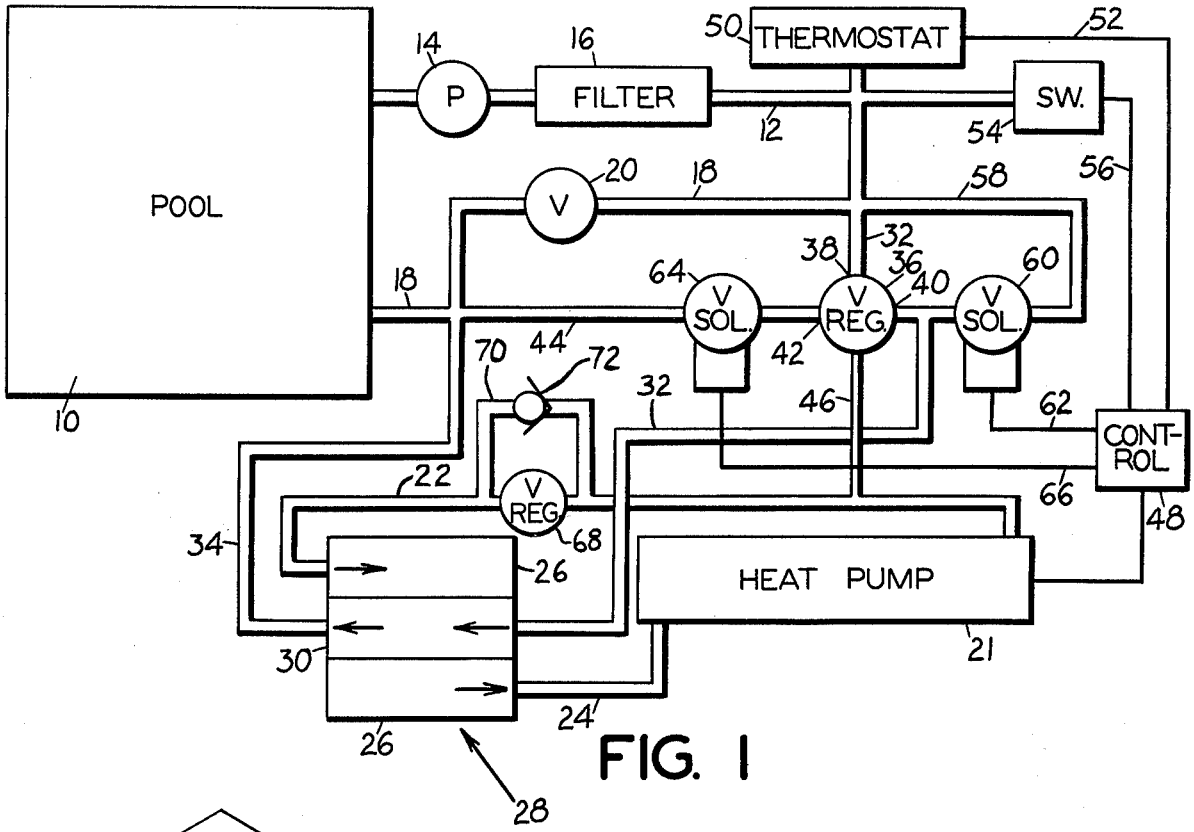
FIG. 1 is a schematic view of the heating system of the present invention.
Figure 2:
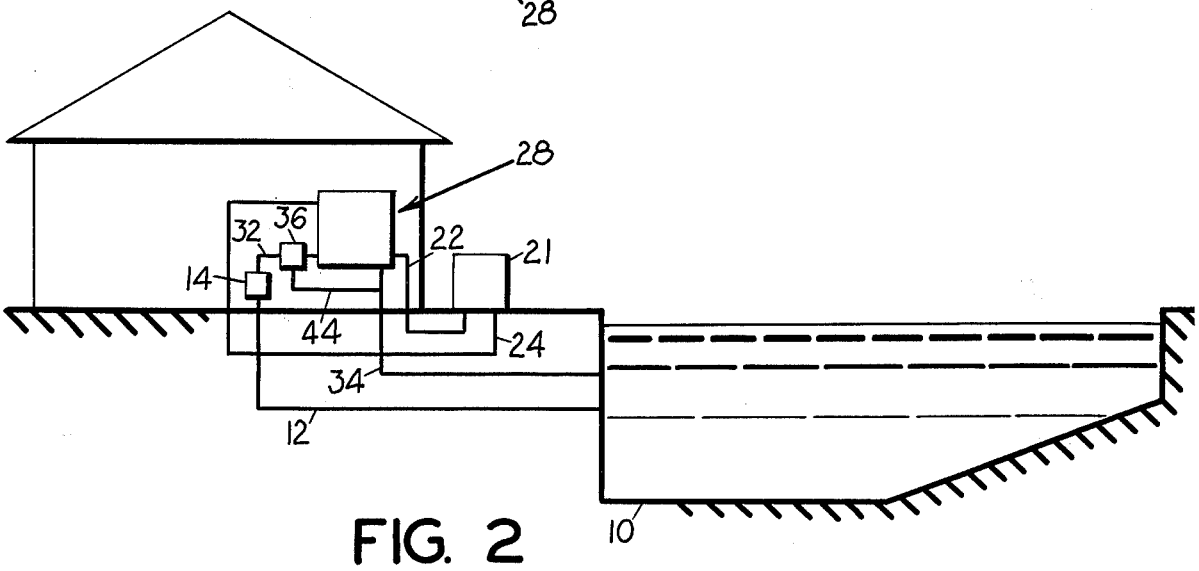
FIG. 2 is a diagrammatic view, in side elevation, showing a typical installation of the heating system.

Referring to FIG. 1 of the drawings, the heating system of the present invention is utilized with a swimming pool 10 having a circulating filtration system including a pool outlet line 12, an electrically operated pump 14, a filter 16, which is located in the pool outlet line, and a pool return line 18. The heating system is connected to the existing filtration system between the pool outlet line and return and a portion of the water is diverted into the system where it is heated after it is filtered. A manually controllable diverter valve 20 is located in the return line to cause a portion of the pool water to be directed through the heating system.

The heating element of the system comprises a commercially available heat pump 21, of appropriate capacity, of the type having a compressor, an expansion valve, an evaporator which receives heat from a heat sink, typically the atmosphere, and a condenser in the form of a heat exchanger where the heat transfer fluid, which has been heated by its being compressed by the compressor, is condensed thereby giving up heat to its surroundings, typically a blower plenum of a forced air furnace. In the present invention the gas-to-gas heat exchanger normally used as the condenser is replaced with a standard gas-to-liquid heat exchanger 28 which has a primary coil 26 which is interconnected to the remainder of the heat pump by means of an outlet line 22 and an inlet line 24. Accordingly, when the heat pump is operated in a heating cycle, heat transfer fluid is discharged from the heat pump as a heated gas at the outlet line 22, is cooled and condensed as it passes through the heat exchanger and is returned to the heat pump through the inlet line 24 as a liquid. The secondary coil 30 of the heat exchanger receives cool pool water, which is diverted by the diverter valve 20, through a system bypass line 32. Thus the pool water receives heat from the heat transfer fluid thereby causing the latter to cool and condense. The heated pool water then is passed to the pool return line through system return line 34.

However, unless controlled, the wide temperature flucuation of the pool water along with its large heat capacity would overwhelm the heat pump, thus causing it to operate over a wide range of conditions which would necessarily result in its being operated inefficiently part of the time. Accordingly, a three-way regulator valve 36 is located in the system bypass line 32 in order to selectively control the portion of pool water diverted to the system which is directed through the heat exchanger. The regulator valve includes an inflow port 38 and a second outflow port 40 which are both connected to the bypass line 32, with the latter port being positioned downstream of the former. The regulator valve also includes a first outflow port 42 which is connected to a regulator return line 44 which interconnects the regulator valve and the pool return line 18.

Located in the regulator valve is pressure-operated control means 45 which is interconnected to the heat pump output line 22 through a control line 46. The control means operates to cause an increasingly greater portion of the water, being diverted to the system, to be directed out of the second outflow port of the regulator valve to the heat exchanger as the pressure at the heat exchanger outlet increases; and an increasingly greater portion of the water to be directed out of the first outflow port to the pool return line as the pressure decreases.

Since the temperature of the heat exchanger fluid is proportional to its pressure, it follows that as the temperature of the heat transfer fluid leaving the heat pump increases, the associated rise in pressure causes the regulator valve to direct a greater portion of the pool water to the heat exchanger, thereby lowering the temperature of the heat exchanger fluid. Likewise, as the temperature of the heat exchanger fluid drops, less pool water is directed to the heat exchanger and thus the temperature of the heat transfer fluid is raised. As a result, the temperature, and thus the pressure, of the heat transfer fluid at the exit of the heat pump is maintained relatively constant. In addition, by appropriately manipulating the regulator control, this temperature and pressure can be adjusted to place them where the heat pump operates at the point of maxium efficiency.

The heat pump is operated by the normal type of controls 48 which start and stop operation of the heat pump responsive to the temperature of the pool water through thermostatic control means 50 which is located in the pool outlet line 12 and is electrically connected to the heat pump control 48 by a wire 52. Also located in the pool outlet line is pressure sensitive control means 54 which transmits a signal to the heat pump control through wire 56 to cause the heat pump to cease operation when the pressure in the pool outlet line drops below a predetermined level. Thus the heat pump is shut down in the event that the pool pump 14 should fail or there is a break or obstruction in either the pool outlet or return line. Otherwise reduced flow of pool water could cause overheating and thus failure of the heat pump.

In most installations outside air serves as the heat source for the heat pump, and when the heat pump is used in a heating mode on cool days its evaporator will periodically accummulate frost. When this occurs, the heat pump control 48 automatically causes operation of the heat pump to be reversed, thus operating it in a refrigeration cycle so that the pool water serves as a sink which transfers heat to the heat transfer fluid through the heat exchanger 28. However, when the regulator valve 36 senses a lowering of the pressure in the heat transfer fluid at the heat pump outlet line 22, due to the lowering of its temperature, it reacts by reducing the amount of pool water which is directed to the heat exchanger and instead directs the water through the regulator return line 44. As a result, as more pool water is required to provide a heating load when the heat pump is being defrosted, less is available.

To overcome this problem defrost bypass means are associated with the regulator valve to override its tendency to provide less cooling water to the heat exchanger when the heat pump is in its defrost cycle and the opposite is desired. The defrost bypass means comprises a defrost bypass line 58 which is connected to the system bypass line 32 on both sides of regulator valve 46. Located in the defrost bypass line 58 is a solenoid-operated first bypass control valve 60, which is electrically activated by the heat pump control 48 through wire 62. Located in the regulator return line 44 is a solenoid-operated second bypass control valve 46 which is electrically activated by the heat pump control 48 through wire 66.

In operation when the heat pump is switched to a defrost cycle by its control 48, the control simultaneously causes the first bypass control valve 60 to open and the second bypass control 64 to close. Thereby all of the pool water is directed around the regulator valve 36 through the defrost bypass line 58 to serve as a heating load for the heat pump.

Also, when the heat pump is operating in its heating cycle, a portion of the heat transfer fluid liquifies and accumulates near the outlet end of the primary coil of the heat exchanger. During defrost the heat pump applies a negative suction pressure to the other end of the primary coil thereby causing this accumulated liquid to evaporate. The evaporation in turn causes a rapid cooling of the remaining liquid which, unless controlled, will cause the pool water in the secondary heat transfer coil to freeze and possibly damage the heat exchanger.

To prevent freezing from occuring pressure regulation means, such as an evaporator pressure regulator valve 68 is located in the heat pump output line 22 between the primary coil 26 and the heat pump 21. The regulator valve is set so that when the heat pump is operating in its refrigeration cycle the pressure in the primary coil is prevented from dropping below a predetermined level where excessively rapid evaporation will occur.

However, since a regulator valve of this type normally only allows flow in one direction, a reverse bypass line 70 extends around the regulator valve 68 in parallel and check valve means 72 located in the bypass line 70 are arranged to permit flow through the bypass line when the heat pump is in its heating cycle and prevent flow through the bypass line when the heat pump is in its refrigeration cycle. Thus the regulator valve 68 is operative to prevent excessively rapid evaporation of liquified heat transfer fluid from the heat exchanger when the heat pump is in its refrigeration cycle and yet does not effect operation of the heater when the heat pump is in its heating cycle.

Accordingly, the present invention provides a heat pump heating system where heat pump operation is automatically tied to the heating demands of the pool and yet the amount of pool water heated is regulated so that the heat pump continually operates at a nearly constant discharge pressure and, therefore, at maximum efficiency. In addition, the system provides for override of the regulator valve which creates the constant operating condition automatically when the heat pump is operated in a refrigeration cycle to defrost its evaporator coil, thereby allowing pool water to be used as a heat sink during defrost.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A heating system for a swimming pool in which water from the pool is circulated by a pump from the pool through a pool outlet line and back into the pool through a pool return line, said system comprising:

(a) a three-way regulator valve having an inflow port which is connected to the pool outlet line, having a first outflow port which is connected to the pool return line and a second outflow port, said valve being operable in a manner such that the amount of fluid entering said inflow port can be selectively divided between said first and second outflow ports;

(b) heat pump means transferring heat to a heat transfer fluid which is circulated through said heat pump means in a closed loop;

(c) a heat exchanger having a primary coil which is interconnected to said heat pump in a manner for circulation of said heat transfer fluid through said primary coil and a secondary coil which is interconnected between said second outflow port of said regulator valve and the return line for circulating the pool water through said secondary coil;

(d) control means associated with said regulator valve for selectively controlling the relative amounts of pool water from said inflow port which are directed to said first and second outflow ports respectively, said control means being sensitive to the pressure of said heat transfer fluid between said heat pump and said primary coil so that an increasingly greater portion of the pool water leaves said regulator valve through said first outflow port when said pressure decreases, and an increasingly greater portion of the pool water leaves said regulator valve through said second outflow port when said pressure increases.

2. The system of claim 1 wherein said pool outlet line is connected to said pool return line including a manually controllable diverter valve located in said pool return line upstream of where said first outflow port and said secondary coil are connected to said pool return line.

3. The system of claim 1 including thermostatic control means responsive to the temperature of the pool water in the pool outlet line for initiating operation of said heat pump when the temperature of the pool water in the pool outlet line drops below a first pedetermined level and terminating operation of said heat pump when the temperature of the pool water in the pool outlet rises above a second predetermined level.

4. The system of claim 1 including pressure control means responsive to the pressure of the pool water in the pool outlet line for terminating the operation of said heat pump when the pressure in the pool outlet line drops below a predetermined level.

5. The system of claim 1 including defrost bypass means associated with said regulator valve for overriding said control means when said heat pump enters a defrost cycle to prevent excessive cooling of said heat exchanger.

6. The system of claim 5 wherein said defrost bypass means includes a bypass line which interconnects said inflow port and said second outflow port of said regulator valve, a first bypass control valve located in said bypass line and a second bypass control valve located between said first outflow port of said regulator valve and the return line.

7. The system of claim 6 including bypass control means operably associated with said heat pump for opening said first bypass valve and closing said second bypass valve when said heat pump enters said defrost cycle.

8. The system of claim 7 including:

(a) pressure regulation means located between said heat pump and said primary coil for preventing the pressure in said primary coil from dropping below a predetermined level when said heat pump is operating in its defrost cycle; and (b) a reverse bypass line interconnected to said pressure regulation means in parallel therewith having check valve means located therein for allowing passage of heat transfer fluid through said reverse bypass line when said heat pump is operating in a heating cycle and preventing passage of heat transfer fluid through said reverse bypass line when said heat pump is operating in a defrost cycle.

* * * * *